United States Patent [19]

Cacicedo

[11] Patent Number: 4,649,597

[45] Date of Patent: Mar. 17, 1987

[54] AUTOMATIC GATE CLOSURE APPARATUS

[76] Inventor: Paulino A. Cacicedo, 5 Tisbury Carriage Dr., Scotch Plains, N.J. 07076

[21] Appl. No.: 817,673

[22] Filed: Jan. 10, 1986

[51] Int. Cl.[4] ..... E05F 1/08

[52] U.S. Cl. ..... 16/76; 16/253; 16/308; 256/26

[58] Field of Search ..... 16/50, 76, 79, 252, 16/253, 285, 304, 307, 308, 382, DIG. 36; 256/26, 29, 30, 31

[56] References Cited

U.S. PATENT DOCUMENTS

| | | | |
|---|---|---|---|
| 403,922 | 5/1889 | Davis | 16/79 |
| 1,130,908 | 3/1915 | Kolashinske | 16/252 |
| 2,025,238 | 12/1935 | Harter | 16/307 X |
| 2,539,151 | 1/1951 | Mills | 16/307 X |
| 3,411,241 | 11/1968 | Harmon | 16/76 X |
| 4,111,401 | 9/1978 | Pickett | 256/26 X |

*Primary Examiner*—Fred Silverberg
*Attorney, Agent, or Firm*—R. Gale Rhodes, Jr.

[57] ABSTRACT

Gate closure apparatus for closing a gate mounted pivotably on a gate post, such apparatus for connection to the gate and gate post and for developing and storing energy upon opening of the gate, and upon release of the gate, the gate closure apparatus for releasing the energy to produce and apply torque to the gate sufficiently large to close the gate; such apparatus may include a coil spring wound in a predetermined direction and having a normal state, upon the gate opening the spring winding in a predetermined direction out of the normal condition (e.g. coiling further tightly) to develop and store the energy, and upon release of the gate, the spring unwinding and returning to the normal condition to produce and apply the torque to the gate.

3 Claims, 9 Drawing Figures

AUTOMATIC GATE CLOSURE APPARATUS

BACKGROUND OF THE INVENTION

This invention relates to apparatus for closing a gate mounted rotatbly on a gate post upon the gate being opened and released; such apparatus also being known in the art as automatic gate closure apparatus, gate return hinge, and spring return hinge.

Various gate closure apparatus of the type noted above are known to the art; however, there still exists a need in the art for such gate closure apparatus which is readily manufacturable, readily installed in the field and in particular which may be connected to an installed gate post without requiring removal and reinstallation of the gate post, and which provides extended periods of reliable operation without the requirement of frequent maintenance.

SUMMARY OF THE INVENTION

It is the object of the present invention to satisfy the above-noted need in the gate closure art.

Gate closure apparatus satisfying this object and embodying the present invention may include apparatus for connection to a gate and a gate post on which the gate is rotatably mounted and which apparatus develops and stores energy upon opening of the gate and which apparatus, upon release of the open gate, releases the stored energy to produce and apply sufficiently large torque to the gate to reclose the gate.

DESCRIPTION OF THE PREFERRED EMBODIMENT

Figure 1:
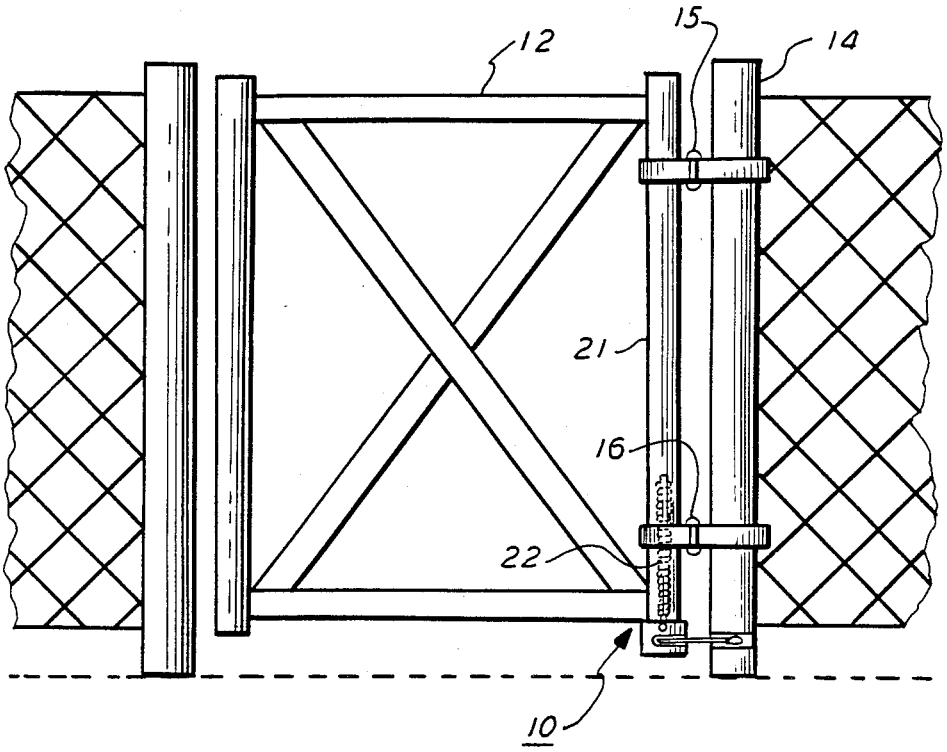
FIG. 1 is a partial side elevational and diagrammatical illustration of gate closure apparatus embodying the present invention and shown connected between a gate and the gate post on which the gate is rotatably mounted.
Figure 2:
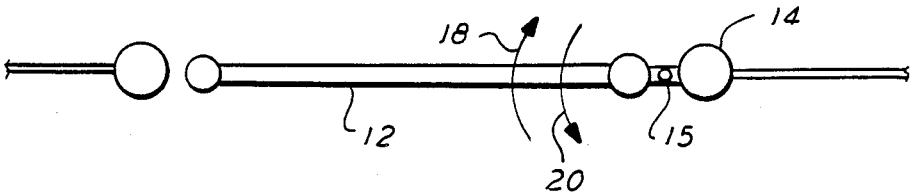
FIG. 2 is a top view of FIG. 1.

Referring now to FIGS. 1 and 2, gate closure apparatus embodying the present invention and indicated by general numerical designation 10 is illustrated connected to a gate 12 mounted pivotably or rotatably on a gate post 14 by hinges 15 and 16. Generally, gate closure apparatus 10 is for developing and storing energy upon opening of the gate 12, for example in the direction of the arrow 18 in FIG. 2, and in the example, for releasing the stored energy to produce and apply sufficiently large torque, indicated by and acting in the direction of the arrow 20 in FIG. 2, to close or reclose the open gate upon release. Further generally, and as may be noted from FIG. 1, in the preferred embodiment gate closure apparatus 10 is mounted internally of the hollow lower portion of gate member 21 of gate 12 and includes a coil spring 22 having a normal state and, upon opening of the gate 12, the coil spring 22 is wound in a predetermined direction out of the normal state, for example coiled more tightly in the preferred embodiment as will be taught in detail below, to develop and store the energy, and upon release of the open gate, the coil spring 22 unwinds and returns to its normal state to produce and apply the torque 20 indicated in FIG. 2 to reclose the gate.

Figure 3:
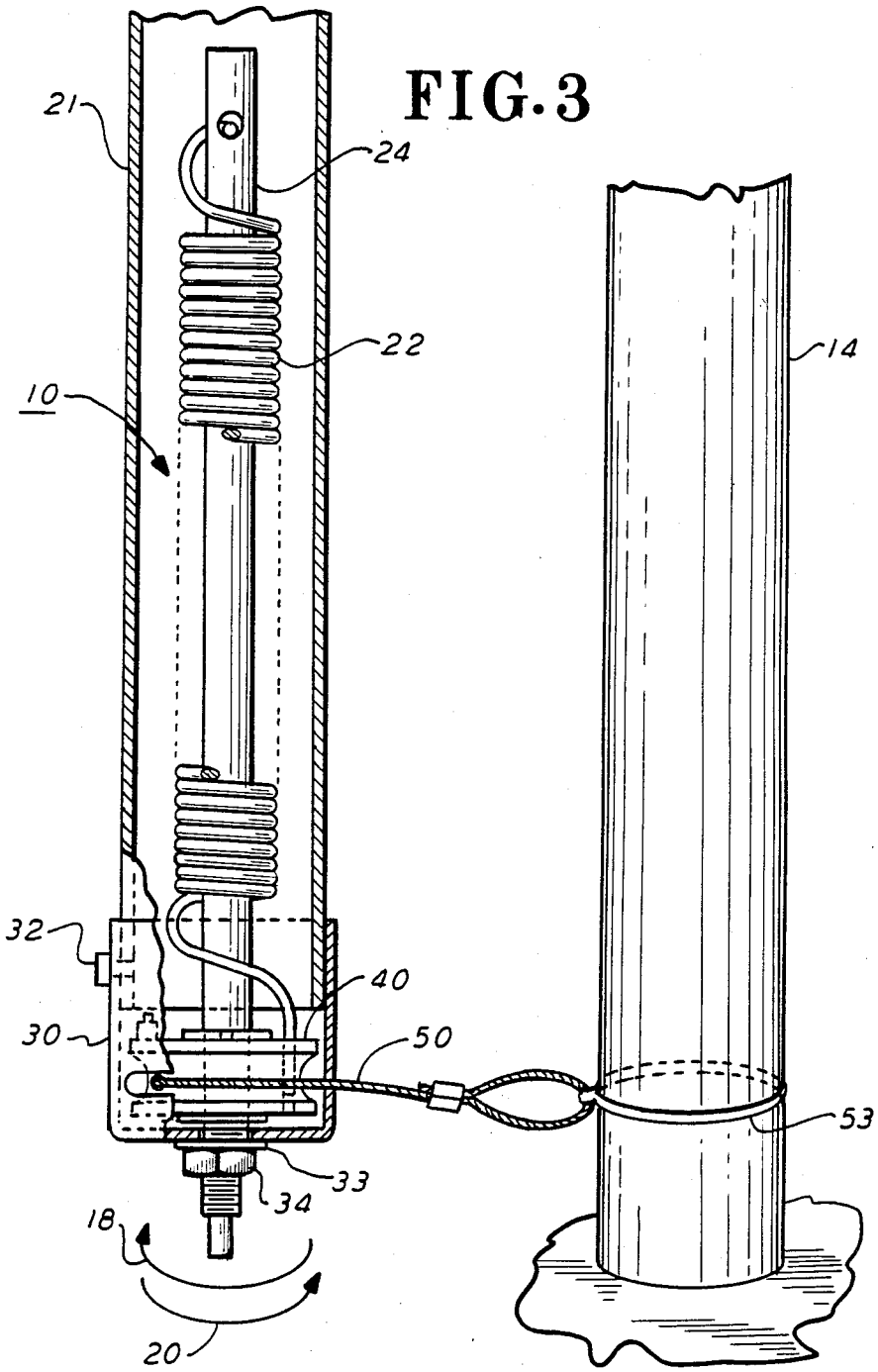
FIG. 3 is an enlarged, partial side elevational view, partially in cross section, illustrating detailed structure of gate closure apparatus embodying the present invention.
Figure 4:
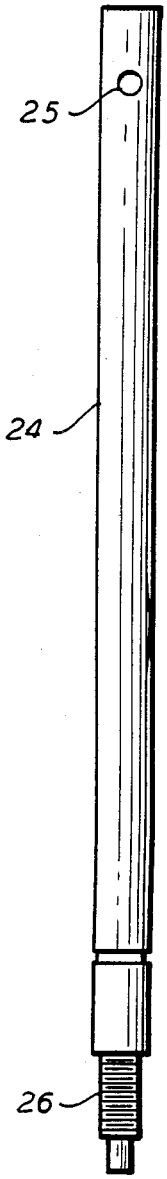
FIG. 4 is a side elevational view of a mounting rod which may be included in the gate closure apparatus of the present invention.
Figure 5:
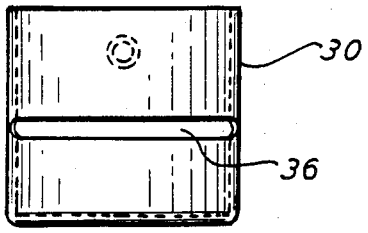
FIG. 5 is a side elevational view of a mounting cup which may be included in the gate closure apparauts of the present invention.
Figure 6:
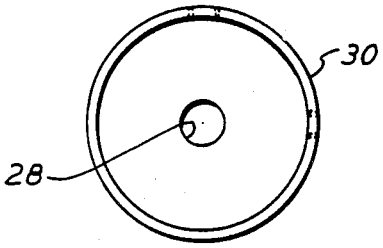
FIG. 6 is a top view of FIG. 5.

An understanding of the detailed structure of gate closure apparatus 10 may be had by reference to FIGS. 3–9, and in particular to FIG. 3, wherein the coil spring 22 of gate closure apparatus 10 is shown wound or mounted around a vertically disposed, longitudinally extending mounting rod 24 residing within the hollow lower portion of the gate member 21. Mounting rod 24, FIG. 4, may be provided at its top end with an aperture or passageway 25 extending horizontally therethrough and the bottom end of the mounting rod 24 may be threaded at 26 as illustrated in FIG. 4. As will be understood from FIG. 3, the bottom end of the mounting rod 24, particularly at the threaded portion 26, extends through an aperture 28, as best seen in FIG. 6, formed centrally of the bottom portion of a mounting cup 30 which, as may be noted from FIG. 3, is mounted over and secured fixedly to the bottom of the gate member 21 such as by a suitable set screw 32. The bottom end of the mounting rod 24 is secured fixedly to the mounting cup 30, and therethrough to the bottom end of the gate member 21, by threaded locking apparatus, such as for example external tooth lock washer 33 and nut 34.

Figure 7:
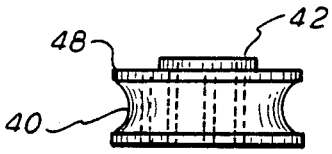
FIG. 7 is a side elevational view of a pulley which may be included in the gate closure apparatus of the present invention.
Figure 8:
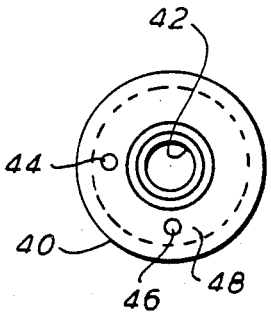
FIG. 8 is a top view of FIG. 7.

Gate closure apparatus 10, as shown in FIG. 3, further includes a horizontally disposed pulley 40 residing within the lower portion of the gate member 12 and mounted rotatably on the mounting rod 24 adjacent and upward of the bottom end thereof; pulley 40, as may be better understood from FIGS. 7 and 8, the pulley 40 is mounted on the lower portion of the rod 24 by a suitable bearing 42 and the upper portion of the pulley 40, as may be best understood from FIG. 8, is provided with apertures 44 and 46 extending through the upper pulley rim or ridge 48.

The upper end of coil spring 22, FIG. 3, is fixedly secured to the top end of mounting rod 24 by being inserted through the mounting rod aperture 25 and thereafter, if desired, may be further fixedly secured to the top end of the mounting rod 24 such as by being bent over or welded to the mounting rod. The bottom end of coil spring 22 is secured fixedly to the pulley 40 by being inserted through the aperture 44 and thereafter bent over or if desired welded to the pulley.

Figure 9:
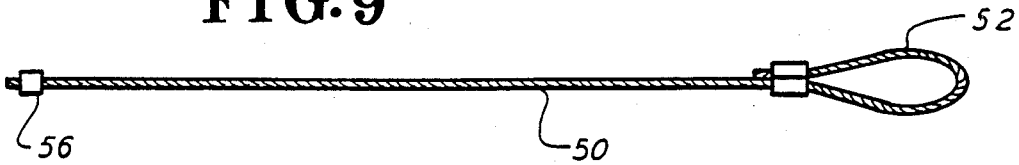
FIG. 9 is a side view of a flexible cable which may be included in the gate closure apparatus of the present invention.

In addition, and referring to FIGS. 3 and 9, gate closure apparatus 10 further includes a flexible cable 50 one end of which is provided with a loop 52 by which the flexible cable 50 may be suitably and conveniently secured fixedly to the gate post 14 such as by a suitable clamp indicated by general numerical designation 53 in FIG. 3 and which clamp may be any one of several commercially available hose or pipe clamps known to the art. The other end of the flexible cable 50 is inserted upwardly through the aperture 46 (FIG. 8) of the pulley 40 whereafter this end of the flexible cable 50 is secured fixedly to the cable such as by the application of a suitable swaging member 56 shown in FIG. 9. The intermediate portion of the flexible cable 50 is wound around the pulley 40, as illustrated in FIG. 3, and it will be understood that the amount of the intermediate portion of the flexible cable 50 wound around the pulley is determined primarily by the number of degrees through which the gate 12, FIGS. 1 and 2, rotates or pivots during opening (e.g. 90°, 180°, or an intermediate number of degrees). As may be further understood by reference to FIG. 3, the flexible cable 50, particularly the intermediate portion, extends through a horizontally extending slot 36 (FIG. 5) provided in the mounting cup 30 and disposed toward the gate post 14. It will be noted that in the preferred embodiment of the gate closure apparatus 10 illustrated in FIG. 3, the coil spring 22 is wound or coiled around the mounting rod 24 in the direction of the arrow 20 (FIGS. 2 and 3) and that the intermediate portion of the flexible cable 50 is wound around the pulley 40 in the opposite direction or in the direction of the arrow 18.

It will now be assumed that the gate closure apparatus 10 of the present invention, and the structural component elements thereof described in detail above, occupy the positions shown in FIG. 3 and that the gate 12 of FIGS. 1 and 2 is being rotated or pivoted open in the direction of arrow 18 in FIGS. 2 and 3. Whereupon, the gate member 21, FIG. 3, the mounting cup 30 secured fixedly to the gate member 21 by set screw 32, the mounting rod 24 due to its bottom end being secured fixedly to the mounting cup 30 by washer 33 and nut 34, and the top end of the coil spring 22 due to being fixedly secured to the mounting rod 24, will all rotate or pivot with the gate 12 in the direction of the arrow 18 also shown in FIG. 3. However, due to one end of the flexible cable 50 being secured fixedly to the gate post 14, the other end secured fixedly to the pulley 40, and due to the pulley 40 being mounted rotatably on the mounting rod 24, the pulley 40 and the bottom end of the coil spring 22, since it is fixedly secured to the pulley 40, will rotate in the opposite direction or in the direction of the arrow 20 of FIGS. 2 and 3. Upon the pulley 40 rotating in the direction of the arrow 20, the flexible cable 50 will unwind from the pulley and the bottom end of the coil spring 22 will be rotated or twisted in the direction of the arrow 20 while the top end of the coil spring 22 will be rotated or twisted in the direction of the arrow 18 thereby causing the coil spring 22 to be coiled more tightly thereby developing and storing energy. Upon the open gate 12 being released, the more tightly coiled coil spring 22 will unwind causing the bottom end of the coil spring and the pulley 40 to rotate in the direction of the arrow 18 to rewind the intermediate portion of the flexible cable 50 on the pulley 40 thereby producing and applying sufficiently large torque indicated by and acting in the direction of the arrow 20 to reclose the gate 12.

It will be further understood that the gate closure apparatus 10 of the present invention may be utilized to close, or automatically close, a gate, such as gate 12, upon the gate 12 opening in the opposite direction from that described above, or upon the gate 12 opening in the direction of the arrow 20 of FIGS. 2 and 3, by merely winding the intermediate portion of the cable 50 in the opposite direction around the pulley 40 without requiring the coil spring 22 to be wound in the opposite direction. In such alternate embodiment, it has been found that the coil spring 22 upon opening of the gate, instead of coiling more tightly as described above, will unwind from its normal state thereby storing energy and upon release of the gate will rewind to its normal state to develop and apply gate closing torque.

It will be further understood by those skilled in the art that many variations and modifications of the present invention may be made without departing from the spirit and the scope thereof.

What is claimed is:

1. Apparatus for closing a gate mounted rotatably on a gate post, said gate including a longitudinally extending, hollow gate member mounted substantially parallel to said gate post, comprising:

gate closure means including a longitudinally extending mounting rod having a top end and a bottom end and residing within the lower portion of said gate member, the bottom end of said mounting rod secured fixedly to the bottom of said gate member, a horizontally disposed pulley residing within said gate member and mounted rotatably on said mounting rod adjacent and upward of the bottom end thereof, a coil spring mounted around said mounting rod and having top and bottom ends with the top end thereof secured fixedly to the top end of said mounting rod and the bottom end of said coil spring secured fixedly to said pulley, and a flexible cable having two ends and an intermediate portion, one end of said cable secured fixedly to said gate post and the other end secured fixedly to said pulley and a portion of said intermediate portion of said flexible cable wound around said pulley;

upon said opening of said gate, said gate and said top end of said coil spring rotate in a first predetermined direction and said bottom end of said coil spring and said pulley under the influence of said flexible cable rotate in a second predetermined direction opposite to said first predetermined direction causing said flexible cable to unwind from said pulley and causing said coil spring to be coiled more tightly thereby developing and storing energy, and upon release of said open gate, said coil spring unwinding causing the bottom end of said coil spring and said pulley to be rotated in said first predetermined direction and causing said flexible cable to be rewound on said pulley thereby producing and applying torque to said gate, said torque acting in said second predetermined direction to close said gate.

2. Apparatus according to claim 1 wherein the bottom end of said mounting rod is threaded and wherein said gate closure means further includes threaded locking means and a mounting cup mounted over and secured fixedly to the bottom of said gate member, said mounting cup having side and bottom portions and said bottom portion provided with a centrally formed aperture through which said threaded bottom end of said mounting rod extends and is fixedly secured to said mounting cup by said threaded locking means, and said side portion of said mounting cup provided with a horizontally extending slot disposed toward said gate post and through which slot said flexible cable extends.

3. Apparatus according to claim 2 wherein said coil spring is wound in said second predetermined direction and said intermediate portion of said flexible cable is wound around said pulley in said first predetermined direction.

* * * * *